US008833821B2

(12) United States Patent
Guerrero

(10) Patent No.: US 8,833,821 B2
(45) Date of Patent: Sep. 16, 2014

(54) GAS CYLINDER LIFTING DEVICE

(71) Applicant: Fred Guerrero, Chowchilla, CA (US)

(72) Inventor: Fred Guerrero, Chowchilla, CA (US)

( * ) Notice: Subject to any disclaimer, the term of this patent is extended or adjusted under 35 U.S.C. 154(b) by 49 days.

(21) Appl. No.: 13/659,972

(22) Filed: Oct. 25, 2012

(65) Prior Publication Data

US 2013/0099515 A1 Apr. 25, 2013

Related U.S. Application Data

(60) Provisional application No. 61/551,149, filed on Oct. 25, 2011.

(51) Int. Cl.

*B66C 1/00* (2006.01)
*B66C 1/44* (2006.01)
*F17C 13/08* (2006.01)

(52) U.S. Cl.

CPC ..... *B66C 1/442* (2013.01); *F17C 2201/032* (2013.01); *F17C 13/084* (2013.01); *F17C 2205/0107* (2013.01); *F17C 2205/0188* (2013.01); *F17C 2201/0104* (2013.01)

USPC ..... 294/67.4; 294/28; 294/31.1

(58) Field of Classification Search

CPC ..... Y10S 294/902; A47J 45/10; B65G 7/12; E21B 19/06; B66C 1/12; B66C 1/442; F16M 13/00; F16M 13/02; F17C 13/084

USPC ..... 294/67.4, 90, 16, 118, 8.5, 28, 31.1, 294/67.1, 67.41, 902, 74; 248/317, 346.01, 248/610

See application file for complete search history.

(56) References Cited

U.S. PATENT DOCUMENTS

| | | | | | |
|---|---|---|---|---|---|
| 1,775,309 | A | * | 9/1930 | Culp | 294/28 |
| 2,029,809 | A | * | 2/1936 | Connolly et al. | 294/28 |
| 3,756,450 | A | | 9/1973 | Crose, Jr. | |
| 3,921,872 | A | | 11/1975 | Buell, Jr. | |
| 4,215,887 | A | * | 8/1980 | Boots | 294/1.4 |
| 4,236,743 | A | | 12/1980 | Fox | |
| 4,458,933 | A | | 7/1984 | Thomas | |
| 4,754,996 | A | | 7/1988 | Tecca et al. | |
| 4,796,936 | A | | 1/1989 | Sherin | |
| 4,846,518 | A | * | 7/1989 | Hamel | 294/99.1 |
| 4,974,800 | A | | 12/1990 | Tyson, Jr. | |
| 5,364,147 | A | * | 11/1994 | Dickey et al. | 294/118 |
| 5,730,479 | A | | 3/1998 | Jansson | |
| 6,079,759 | A | * | 6/2000 | Payne et al. | 294/32 |
| 6,386,384 | B1 | | 5/2002 | Chohfi et al. | |
| 6,840,556 | B1 | * | 1/2005 | Catlett | 294/16 |
| 7,703,821 | B2 | | 4/2010 | Swain | |
| 2004/0188377 | A1 | | 9/2004 | Balade | |
| 2010/0001482 | A1 | | 1/2010 | More | |
| 2011/0298229 | A1 | * | 12/2011 | Hager et al. | 294/31.1 |

* cited by examiner

*Primary Examiner* — Stephen Vu
(74) *Attorney, Agent, or Firm* — Buckingham, Doolittle & Burroughs, LLC

(57) ABSTRACT

A lifting device for safely gripping and moving compressed gas cylinders is provided. The lifting device comprises a first and a second gripping element that slide over the top of the compressed gas cylinder and a plurality of gasket elements that engage the cylinder by friction as the lifting device scissors together permitting a user to safely move the cylinder.

11 Claims, 5 Drawing Sheets

GAS CYLINDER LIFTING DEVICE

CROSS-REFERENCE

This application claims priority from Provisional Patent Application Ser. No. 61/551,149 filed Oct. 25, 2011.

FIELD OF THE INVENTION

This invention pertains generally to a device for safely gripping and lifting gas cylinders, and more particularly to a device for engaging, lifting and manipulating compressed gas cylinders.

BACKGROUND

Gas cylinders, which are common in manufacturing and medical industries, regularly present rigging and lifting challenges. As these cylinders are typically unwieldy and heavy, repositioning or manipulations of these cylinders typically require multiple individuals. In addition, complicated rigging systems are often employed containing multiple components such as harnesses, slings, chains, and carabineers, and the like. Traditional methods of maneuvering such cylinders are not only complicated, but time consuming as well. Once the cylinder is moved, the rigging systems must be dismantled requiring additional manpower. As cylinders must be frequently moved and removed, constantly rigging, unrigging, and re-rigging the cylinders is extremely inefficient.

Consequently, there exists a need for a more efficient and safer tool designed to quickly engage a compressed gas cylinder and move it safely with a single person. The present invention discloses a device for lifting and positioning a compressed gas cylinder safely and efficiently without the need for a complicated rigging system. The device allows a single worker to easily lift and move a bulky heavy gas cylinder. The device is able to engage the cylinder securely and easily be disengaged once no longer needed.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a lifting device for a gas cylinder. The lifting device comprises a first gripping element and a second gripping element coupled together to form a first pivot point and a second pivot point. The first gripping element and the second gripping element comprise a first attachment point and a second attachment point respectively. The first and the second pivot points allow the first and second gripping elements to slide over a compressed gas cylinder and then scissor together against the compressed gas cylinder when the first and the second attachment points are pushed upward.

Furthermore, in a preferred embodiment of the invention, the lifting device slides over the compressed gas cylinder when in an open position, then grips the compressed gas cylinder when in an engaged position. In the engaged position, a plurality of gasket elements attachable to the first and the second gripping element abut the compressed gas cylinder so that the plurality of gasket elements are frictionally engaged with the compressed gas cylinder. To move the compressed gas cylinder, a user may attach chains, cables, or the like to first a attachment point and a second attachment point for leverage. Additionally, the lifting device may further comprise a base element attachable to the first and the second gripping element for engaging a base of the compressed gas cylinder to provide stability.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
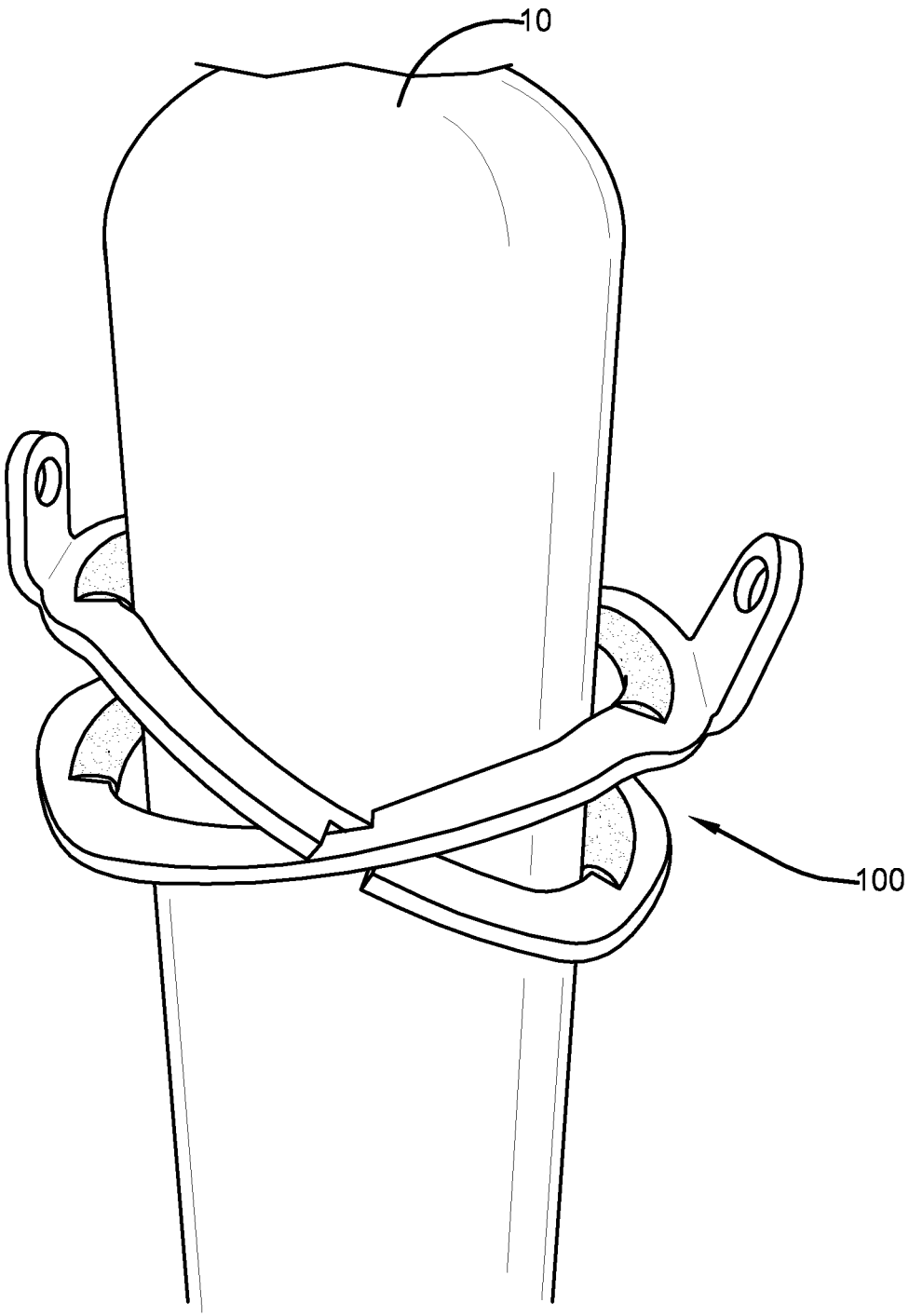
FIG. 1 illustrates a perspective view of a lifting device engaging a gas cylinder in accordance with the disclosed architecture.

The present invention discloses a lifting device for moving a compressed gas cylinder. The lifting device minimizes the number of components while maximizing lifting capacity by leveraging itself against the compressed gas cylinder. A pair of gripping elements comprising interlocking steel plates fit around the cylinder via a relatively "scissored-like" hold to secure the cylinder container for lifting. The lifting device comprises a plurality of replaceable gaskets, which provide increased friction at a plurality of lifting points on the cylinder. The lifting device may further comprise a base element for cradling a base of the cylinder attachable to the pair of gripping elements with a plurality of cables if the cylinder requires overhead lifting. The base element is easily removable if not needed. The lifting device is designed to manipulate industry standard gas cylinders but is also customizable to adapt to non-standard cylinders as well.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

Figure 2:
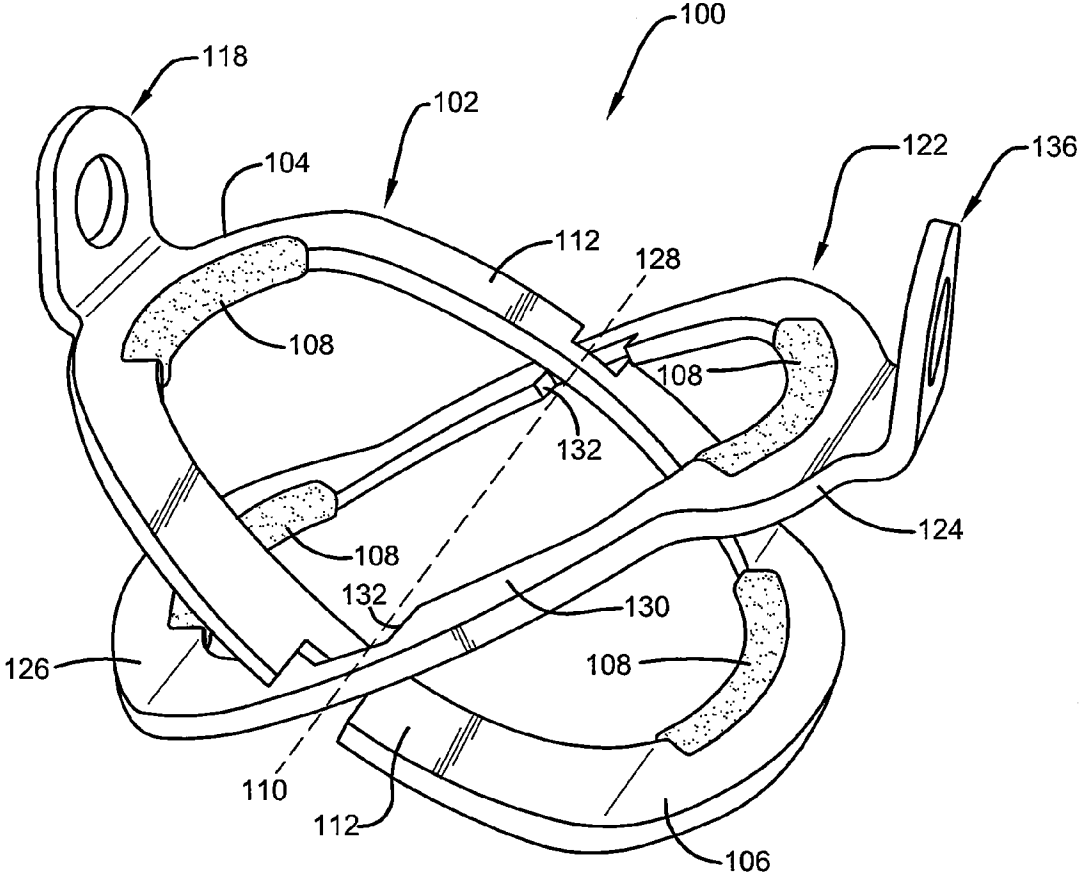
FIG. 2 illustrates a perspective view of the lifting device in accordance with the disclosed architecture.

Referring initially to the drawings, FIGS. 1 and 2 illustrate a lifting device 100 for moving and manipulation of a compressed gas cylinder 10 (cylinder). The lifting device 100 comprises a first gripping element 102 coupled together with a second gripping element 122. Both the first gripping element 102 and the second gripping element 122 are typically steel plates formed into rings generally round or elliptical in shape. While the first gripping element 102 and the second gripping element 122 are generally constructed of steel, any other suitable durable material such as composite materials, plastics, aluminum, and the like, as is known in the art may be used without affecting the overall scope of the invention.

The first gripping element 102 comprises a top 104, a bottom 106, and a pair of sides 112. Similarly, the second gripping element 122 comprises a top 124, a bottom 126, and a pair of sides 130. The first gripping element 102 and the second gripping element 122 are approximately identical in dimensions. The first gripping element 102 and the second gripping element 122 may be preferably dimensioned to accept compressed gas cylinders 10 approximately between nine and 9½ inches in diameter weighing up to 250 pounds. However, the first gripping element 102 and the second gripping element 122 may be customized to accept smaller and/or larger diameter cylinders, such as between eight and twelve inches, as desired. This is desirable as it conforms to the Occupational Safety and Health Association's 50 pound lifting limit requirement.

Figure 3A:
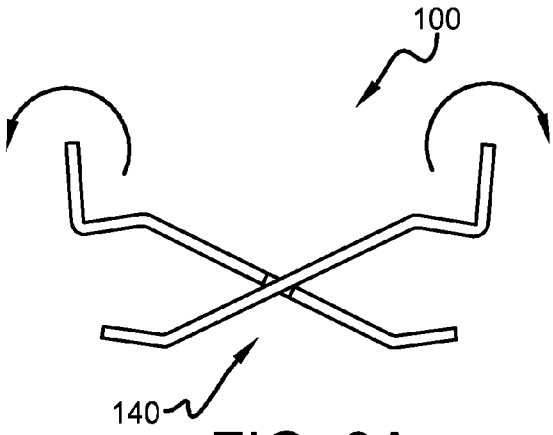
FIG. 3A illustrates a side perspective view of the lifting device in an open position in accordance with the disclosed architecture.
Figure 3B:
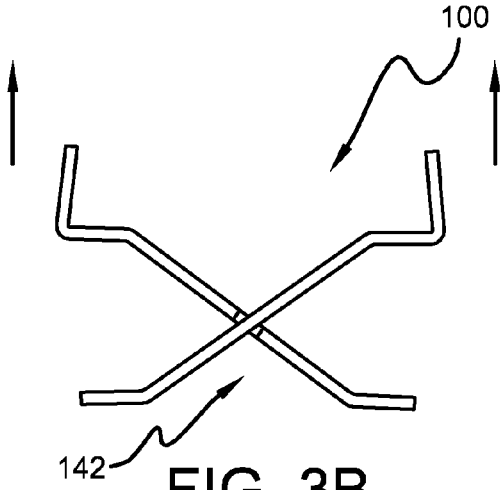
FIG. 3B illustrates a side perspective view of the lifting device rotating between the open position and an engaged position in accordance with the disclosed architecture.

Additionally, the first gripping element 102 and the second gripping element 122 are angled so that when in place in an engaged position 142, as in FIG. 3B, the top 104 and 124 and the bottom 106 and 126 are generally parallel to each other and generally perpendicular to the cylinder 10. The pair of sides 112 and 130 connects the top 104 and 124 and the bottom 106 and 126 at approximately a 30 degree angle.

The first gripping element 102 and the second gripping element 122 each further comprise a slotted portion 114 and 132 respectively. The slotted portions 114 and 132 are located along the pair of sides 112 and 130 approximately midway or equidistant between the top 104 and 124 and the bottom 106 and 126, thereby encompassing the midpoints 110 and 128. The slotted portions 114 and 132 are cutouts in the pair of sides 112 and 130 approximately 1½ inches in length and approximately ¾ inches deep from the inside diameters, and form a first pivot point and a second pivot point to movably couple together the first and the second gripping elements 102 and 122. Generally, the first and the second pivot points are slip joints.

Further, each of the tops 104 and 124 and the bottoms 106 and 128 each comprise a plurality of gasket elements 108 attachable to an inside diameter of the top and an inside diameter of the bottom of the first and the second gripping elements 102 and 122. The plurality of gasket elements 108 are generally constructed of rubber, however any other suitable durable material such as composite materials, plastics, silicon, polymers, and the like, as is known in the art may be used without affecting the overall scope of the invention. The plurality of gasket elements 108 are removable and attach or are otherwise molded into the tops 104 and 124 and the bottoms 106 and 128 of the first and the second gripping elements 102 and 122. The plurality of gasket elements 108 may be attached with adhesive, pressure, heat, mechanical fasteners, and the like.

The first and the second gripping elements 102 and 122 further comprise a first attachment point 118 and a second attachment point 136 respectively. The first and the second attachment points 118 and 136 are generally rigid flaps or rings with an internal diameter that extends upward perpendicularly out of the tops 104 and 124 of the first and the second gripping elements 102 and 122.

Figure 3C:
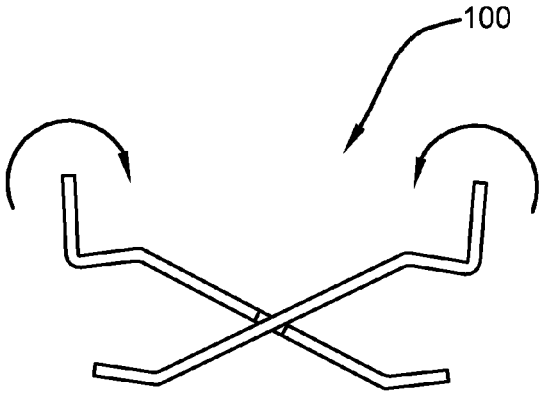
FIG. 3C illustrates a side perspective view of the lifting device in an engaged position in accordance with the disclosed architecture.

To operate the lifting device 100, as illustrated in FIGS. 3A-3C, a user rotates the first and the second gripping elements 102 and 122 along the first and the second pivot points between the open position 140 and an engaged position 142. The user first rotates the first and the second gripping elements 102 and 122 into the open position 140 by pushing downward so that the tops 104 and 124 move toward the bottoms 106 and 126. Once in the open position 140, the first and the second gripping elements 102 and 122 are placed over a top of the cylinder 10 and moved to a position along a body of the cylinder 10. Once in position, the first and the second gripping elements 102 and 122 may be rotated upward by pulling upward so that the tops 104 and 124 move from the bottoms 106 and 126 in a scissoring motion to achieve the engaged position 142.

In the engaged position 142, the plurality of gaskets 108 engage the cylinder 10 holding the lifting device 100 in place through friction. The plurality of gaskets 108 apply pressure generally perpendicularly to the cylinder 10 as the lifting device 100 is pulled upward from the first and the second attachment points 118 and 136. To lift the cylinder 10 vertically, a plurality of chains, cables, ropes, or the like may be attached to the first and the second attachment points 118 and 136 and pulled upward. To remove the lifting device 100 from the cylinder 10, the process is reversed by lowering the source of the lift and moving the first and the second gripping elements 102 and 122 back to the open position 140. Then the lifting device 100 may be removed from the cylinder 10 once the pressure is released.

Figure 4:
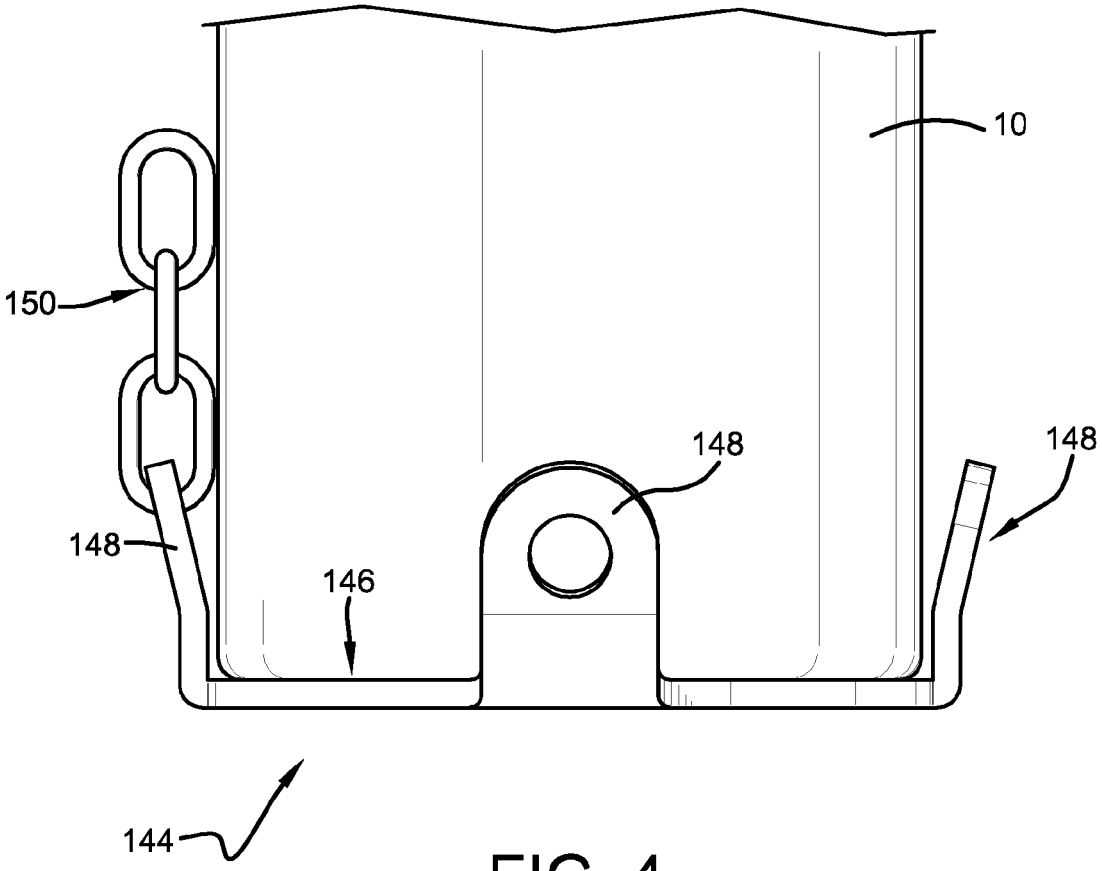
FIG. 4 illustrates a side perspective view of an attachable base element for use with the lifting device in accordance with the disclosed architecture.
Figure 5:
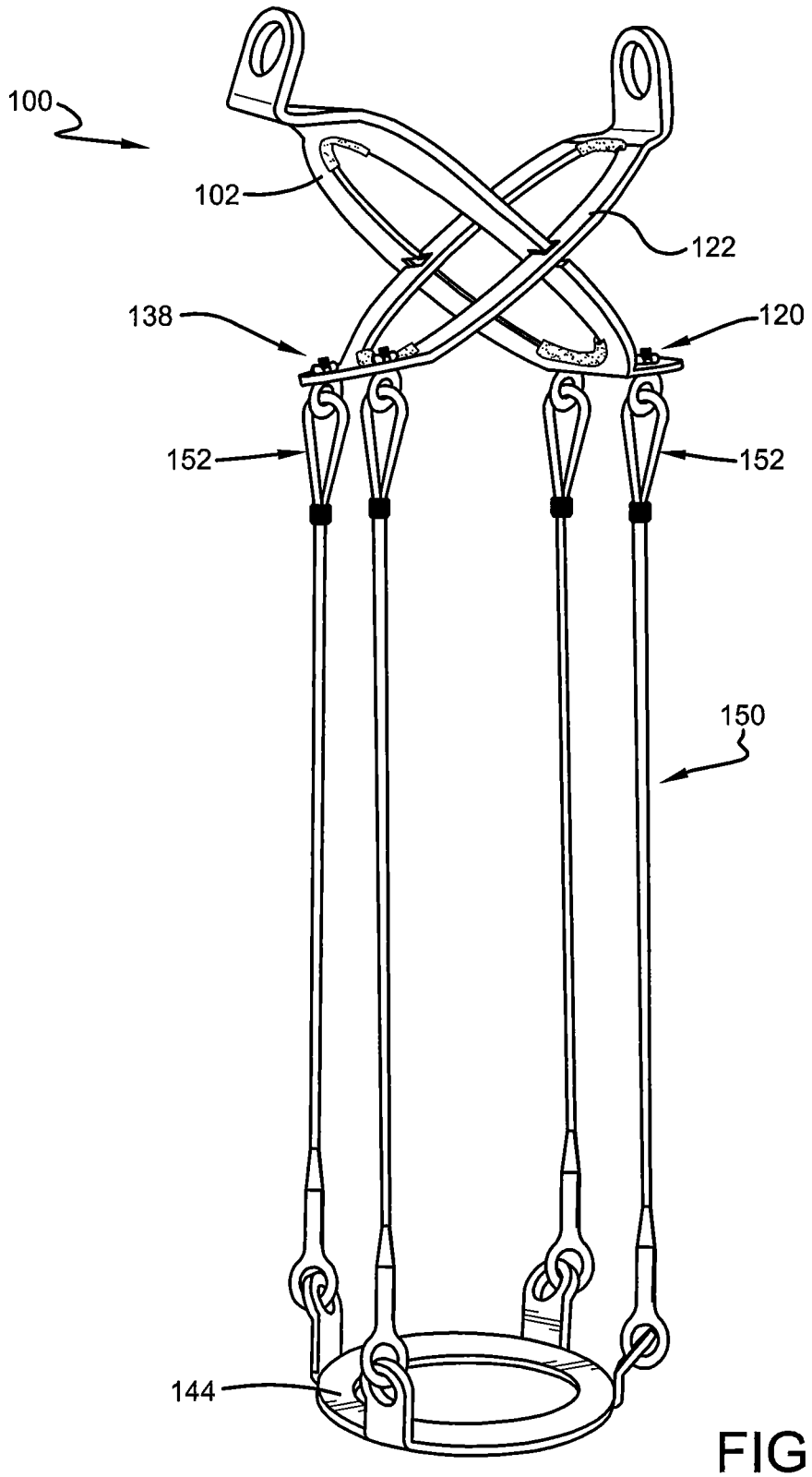
FIG. 5 illustrates a side perspective view of the lifting device in conjunction with the attachable base element in accordance with the disclosed architecture.

As illustrated in FIGS. 4 and 5, the lifting device 100 may further comprise a base element 144, generally for heavier cylinders and for moving cylinders horizontally and vertically, attachable to the first and the second gripping elements 102 and 122 with a plurality of cable elements 150. The plurality of cable elements 150 may comprise chains, cables, ropes or the like. The base element 144 comprises a cylinder receiving portion 146 and a plurality of cable attachment points 148. The cylinder receiving portion 146 is generally a metal plate or ring that engages a bottom of the cylinder 10 so that the cylinder 10 is further supported by the lifting device from the bottom. The plurality of cable attachment points 148 form ears integrated with the cylinder receiving portion 146 at an angle approximately 90 degrees upward To utilize the first and the second gripping elements 102 and 122 along with the base element 144, the cylinder 10 is placed into the cylinder receiving portion 146 of the base element 144, and the plurality of cable elements 150 are attached with snap lift rings, D-rings, carabineers, triangles, and the like 152, or by any other method of connecting cables as is known in the art. The first and the second gripping elements 102 and 122 may further comprise a plurality of base attachment points 120 and 138 extending downward out of the bottoms 106 and 126 of the first and the second gripping elements 102 and 122. The plurality of base attachment points 120 and 138 may comprise eyelets, hooks, rings, and the like, or any other attachment fixtures as is known in the art. The first and the second gripping elements 102 and 122 are then placed over the cylinder 10, and are attached to the plurality of cable elements 150 in a similar manner as to the base element 144 at the plurality of base attachment points 120 and 138. Once the lifting device 100 is in place, the cables attached to the first and the second attachment points 118 and 136 are lifted upward moving the lifting device to the engaged position 142 and the cylinder 10 may be moved as described supra. Once the cylinder 10 is moved to the desired position, the process is reversed, and the lifting device 100 is removed from the cylinder 10.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gas cylinder lifting device comprising:

a first gripping element and a second gripping element coupled together, wherein the first and the second gripping elements comprise a first and a second attachment point; and a first pivot point and a second pivot point, wherein the first and the second pivot points are created by coupling the first and the second gripping elements together so that the gas cylinder lifting device is in an engaged position when the first and the second gripping elements are rotated inward; and a base element attachable to the first and the second gripping element with a plurality of cable elements, wherein the base element comprises a cylinder receiving portion and a plurality of cable element attachment points.

2. The lifting device of claim 1, wherein the first and the second gripping elements each further comprise a top, a bottom, and a pair of sides.

3. The lifting device of claim 2, wherein the pair of sides each comprise a slotted portion generally equidistant from the top and the bottom for coupling the first gripping element and the second gripping element together.

4. The lifting device of claim 3, wherein the top and the bottom each comprise a gasket element attachable to an inside diameter of the top and an inside diameter of the bottom of the first and the second gripping elements.

5. The lifting device of claim 4, wherein the gasket elements are removable.

6. A lifting device for gripping and lifting a gas cylinder, the lifting device comprising:

a first gripping element and a second gripping element coupled together, wherein the first and the second gripping elements comprise a first and a second attachment point; and a first pivot point and a second pivot point, wherein the first and the second pivot points are created by coupling the first and the second gripping elements together generally at a midpoint of the first and the second gripping elements; and a base element attachable to the first and the second gripping elements with a plurality of cable elements for moving the gas cylinder horizontally and vertically, wherein the base element comprises a cylinder receiving portion and a plurality of cable element attachment points.

7. The lifting device of claim 6, wherein the first gripping element and the second gripping element further comprise formed steel plate rings.

8. The lifting device of claim 6, wherein the lifting device is in an engaged position when the first gripping element and the second gripping element are rotated inward.

9. The lifting device of claim 6, wherein the lifting device is in an open position when the first gripping element and the second gripping element are pushed downward.

10. The lifting device of claim 6, wherein first gripping element and a second gripping element each further comprise a plurality of gasket elements comprised of at least one of the following materials: rubber, silicon, plastic, or polymer.

11. The lifting device of claim 6, wherein the lifting device engages and moves compressed gas cylinders between nine and 9½ inches in diameter, and between 20 and 250 pounds in weight.

* * * * *